US011717059B2

(12) United States Patent
Cheng

(10) Patent No.: US 11,717,059 B2
(45) Date of Patent: Aug. 8, 2023

(54) BUCKLE STRUCTURE, BUCKLE ASSEMBLY AND BABY CARRIER

(71) Applicant: Wonderland Switzerland AG, Steinhausen (CH)

(72) Inventor: Manqun Cheng, Guangdong (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 17/336,341

(22) Filed: Jun. 2, 2021

(65) Prior Publication Data

US 2021/0378364 A1 Dec. 9, 2021

(30) Foreign Application Priority Data

Jun. 3, 2020 (CN) ..... 202010498433.X

(51) Int. Cl.
*A44B 11/25* (2006.01)
*A44B 11/00* (2006.01)

(52) U.S. Cl.
CPC ..... *A44B 11/25* (2013.01); *A44B 11/006* (2013.01)

(58) Field of Classification Search
CPC ..... Y10T 24/4736; Y10T 24/4086; Y10T 24/4093; A44B 11/258; A44B 11/266; A44B 11/2553; A44B 11/2557; A44B 11/06; A44B 11/10; A44B 11/125; A44B 11/12; A44B 11/006; A44B 11/25
See application file for complete search history.

(56) References Cited

U.S. PATENT DOCUMENTS 2,981,993 A * 5/1961 Elsner ..... B60P 7/0823 24/193
6,247,210 B1 * 6/2001 Hamilton ..... A44B 11/006 24/200
6,360,410 B1 * 3/2002 Lovato ..... A44B 11/266 24/625
6,647,750 B2 * 11/2003 Kaneko ..... A44B 11/263 70/57.1

FOREIGN PATENT DOCUMENTS

CN 208259203 U 12/2018

* cited by examiner

*Primary Examiner* — Robert Sandy
(74) *Attorney, Agent, or Firm* — Volpe Koenig

(57) ABSTRACT

A buckle structure is adapted to connect a strap. The buckle structure has a connecting port. The connecting port has a connecting member for connecting the strap. An extending portion extends from a side of the connecting port. The extending portion has an opening for the strap to pass through. The strap passes through the opening to enter the connecting port and connect the connecting member.

24 Claims, 8 Drawing Sheets

BUCKLE STRUCTURE, BUCKLE ASSEMBLY AND BABY CARRIER

BACKGROUND OF THE INVENTION

1. Field of the Invention

The invention relates to a baby product and, more particularly, to a buckle structure, a buckle assembly and a baby carrier.

2. Description of the Prior Art

A caregiver's hands can be freed by using a baby carrier, for the baby carrier is to carry a baby without affecting intimate contacts between the baby and the caregiver. The design of the baby carrier must not only conforms the ergonomics of a user to reduce the burden, but also supports the buttocks, waist, neck and head of the baby. The design of the baby carrier is to avoid bending and unnecessary pressure and ensure the comfort and safety of the baby, so as to protect the weak muscles and bones of the baby.

As shown in FIGS. 1 to 3, the existing front-facing baby carrier 900 comprises a sling 91, a protective member 92, a strap 93 and a buckle 94. The buckle 94 comprises a female buckle 941 and a male buckle 942, wherein the female buckle 941 and the male buckle 942 are facing each other and are detachably fastened to each other. The female buckle 941 is detachably connected to the male buckle 942 by mechanical engagement and/or magnetic attraction. The male buckle 942 is disposed on the sling 91. The protective member 92 is connected to the strap 93. The female buckle 941 has a connecting port 9411. A connecting rod 9412 is disposed in the connecting port 9411. The strap 93 is inserted into the connecting port 9411 from the bottom of the female buckle 941, bypasses the connecting rod 9412, and then passes through the bottom of the female buckle 941, such that the strap 93 is connected to the female buckle 941 and the length of the strap 93 is adjustable with respect to the female buckle 941.

When in use, the engagement between the female buckle 941 and the male buckle 942 connects the protective member 92 and the sling 91. However, because a lock portion 9413 (recess structure) of the female buckle 941 is closer to the protective member 92 than other parts of the female buckle 941, and the strap 93 enters and exits from the bottom of the female buckle 941. Therefore, the strap 93 will protrude or bulge from a side of the female buckle 941 that is adjacent to the male buckle 942. Because the protruded or bulged strap 93 is just located between the female buckle 941 and the male buckle 942, the protruded or bulged strap 93 will prevent the female buckle 941 from being firmly engaged with the male buckle 942, such that there would be a large gap between the female buckle 941 and the male buckle 942 to form a state of "false engagement".

When the female buckle 941 and the male buckle 942 are connected by magnetic attraction and during an alignment and an approaching of the two buckles, the female buckle 941 and the male buckle 942 are attracted to each other faster than non-magnetic coupling Therefore, it is difficult to adjust the female buckle 941 and the male buckle 942 during the engagement. When the user feels that the female buckle 941 and the male buckle 942 have been contacting each other by magnetic attraction, the user may mistakenly believe that the female buckle 941 and the male buckle 942 were firmly engaged and ignore the state of "false engagement".

When in use, the "false engagement" between the female buckle 941 and the male buckle 942 may be disengaged easily by an external force, which brings great safety concerns. To ensure that the female buckle 941 and the male buckle 942 are precisely engaged, the user must take time to arrange the strap 93 first, such that the strap 93 will not protrude or bulge. Then, the user engages the female buckle 941 with the male buckle 942. It is still necessary to observe the state of engagement to prevent "false engagement". The operation is complicated and time-consuming.

Therefore, it is necessary to provide a buckle structure, a buckle assembly and a baby carrier with good engagement and quick and convenient operation, thereby solving the aforesaid problems.

SUMMARY OF THE INVENTION

An objective of the invention is to provide a buckle structure that facilitates the connection of a strap and the strap does not block the engagement.

Another objective of the invention is to provide a buckle assembly with a buckle structure and an auxiliary buckle structure that can be quickly engaged and has a good engagement.

Another objective of the invention is to provide a baby carrier. The baby carrier has a buckle assembly with a buckle structure and an auxiliary buckle structure that can be quickly engaged and has a good engagement. The buckle assembly makes the use of the baby carrier safer and more reliable, and the operation is quick and convenient.

To achieve the aforesaid objective, the invention provides a buckle structure. The buckle structure is adapted to connect a strap. The buckle structure has a connecting port. The connecting port has a connecting member for connecting the strap. An extending portion extends from a side of the connecting port. The extending portion has an opening for the strap to pass through. The strap passes through the opening to enter the connecting port and connect the connecting member.

Compared to the prior art, the buckle structure of the invention has the connecting port and the connecting port has the connecting member for connecting the strap. An extending portion extends from a side of the connecting port of the buckle structure and the extending portion has an opening for the strap to pass through. The strap passes through the opening to enter the connecting port and connect the connecting member. Accordingly, when the buckle structure of the invention is being connected to the strap, the strap is not directly inserted into the connecting port, but first inserted from the outside of the opening on the extending portion and then inserted into the connecting port to connect the connecting member, such that the strap is bent by the extending portion and the opening, and is then connected with the connecting member. Accordingly, the strap is effectively restrained and close to the buckle structure, such that the strap does not protrude or bulge on the buckle structure, so as to prevent undesirable connection between the buckle structure and the auxiliary buckle structure. At the same time, the extension of the extending portion on the buckle structure prevents the strap from protruding or bulging on the buckle structure. As mentioned in the above and compared to the prior art, since the invention adds the extending portion and the opening thereof, the strap will not protrude or bulge, such that the strap will not block the engagement of the buckle structure, thereby making the strap be connected more convenient and quicker. Moreover, because the strap does not protrude or bulge on the buckle structure, the buckle structure can be tightly attached to the auxiliary buckle structure every time when they are engaged. Even if the buckle structure and the auxiliary buckle structure are engaged by magnetic attraction, the engagement will not be affected by a protrusion or bulge of the strap. That is to say, the engagement between the buckle structure and the auxiliary buckle structure is always a precise engagement. The precise engagement effectively prevents the "false engagement". The false engagement is when the buckle structure and the auxiliary buckle structure are magnetically attracted by each other but not engaged, therefore the user may mistakenly believe that the buckle structure and the auxiliary buckle structure were firmly engaged.

Preferably, the buckle structure forms the extending portion along a longitudinal direction thereof.

Preferably, after entering the connecting port and connecting the connecting member, the strap passes through the opening again.

Preferably, the strap is slidably connected to the connecting member and a length of the strap is adjustable.

Preferably, the strap is wound around the connecting member.

Preferably, the connecting member is pivotally disposed on the buckle structure.

Preferably, the opening faces the connecting member.

Preferably, a width of the opening gradually expands in a direction toward the connecting member.

Preferably, the buckle structure further comprises a partition separating the connecting port from the opening, the partition is arranged in a width direction of the buckle structure, and the connecting port and the opening are arranged in a longitudinal direction of the buckle structure in sequence.

Preferably, the extending portion is located below the partition in a height direction of the buckle structure, and the extending portion and the partition form a stair structure.

Preferably, the extending portion is a ring-shaped structure, the ring-shaped structure surrounds the opening, and a top of the extending portion has an inclined structure inclined toward a lower end of the connecting port.

Preferably, an extension line of the inclined structure is apart from a lowermost end of the connecting member by a specific distance.

Preferably, an extension line of the inclined structure is apart from a lowermost end of the connecting member by a distance at least larger than a thickness of the strap.

Preferably, a bottom of the buckle structure is flat.

A buckle assembly of the invention comprises the aforesaid buckle structure and an auxiliary buckle structure, wherein the buckle structure and the auxiliary buckle structure are capable of being superimposed and plugged with each other.

Compared to the prior art, the buckle assembly of the invention comprises the aforesaid buckle structure and the auxiliary buckle structure capable of being superimposed and plugged with the buckle structure. Since the buckle structure has the extending portion and the opening, the strap is first inserted from the outside of the opening on the extending portion and then inserted into the connecting port to connect the connecting member, such that the strap is bent by the extending portion and the opening, and is then connected with the connecting member. Accordingly, the strap is restrained and close to the buckle structure, such that the strap does not protrude or bulge on the buckle structure. Furthermore, the extension of the extending portion on the buckle structure prevents the strap from protruding or bulging on the buckle structure. Since the strap will not protrude or bulge on the buckle structure, the strap will not block the engagement between the buckle structure and the auxiliary buckle structure, such that the buckle structure and the auxiliary buckle structure can be engaged with each other quickly. Because there is no strap between the buckle structure and the auxiliary buckle structure, the "false engagement" will not occur between the buckle structure and the auxiliary buckle structure. The engagement between the buckle structure and the auxiliary buckle structure will be a precise engagement. The buckle structure and the auxiliary buckle structure will not be disengaged from each other easily by an external force. Without being blocked by the strap, the buckle structure and the auxiliary buckle structure can be directly superimposed and plugged, and it does not need to take time to arrange the strap between the buckle structure and the auxiliary buckle structure. The operation is convenient and quick. Because the strap does not protrude or bulge on the buckle structure, the buckle structure can be tightly attached to the auxiliary buckle structure every time when they are engaged. Even if the buckle structure and the auxiliary buckle structure are engaged by magnetic attraction, the engagement will not be affected by a protrusion or bulge of the strap. That is to say, the engagement between the buckle structure and the auxiliary buckle structure is always a precise engagement. The precise engagement effectively prevents the "false engagement". The false engagement is when the buckle structure and the auxiliary buckle structure are magnetically attracted by each other but not engaged, therefore the user may mistakenly believe that the buckle structure and the auxiliary buckle structure were firmly engaged. Therefore, the engagement operation of the buckle assembly is simpler and more convenient.

Preferably, the buckle structure has a lock portion, the auxiliary buckle structure has an auxiliary lock portion for locking with the lock portion, and the buckle structure and the auxiliary buckle structure are superimposed and plugged with each other, such that the lock portion and the auxiliary lock portion are locked.

Preferably, the buckle structure has a first attaching surface facing the auxiliary buckle structure, the auxiliary buckle structure has a second attaching surface facing the buckle structure, and the first attaching surface is attached to the second attaching surface after the buckle structure and the auxiliary buckle structure are plugged with each other.

Preferably, the lock portion is disposed on the first attaching surface, the auxiliary lock portion is disposed on the second attaching surface, and the opening and the connecting port are disposed on a side surface of the buckle structure opposite to the first attaching surface.

Preferably, one of the lock portion and the auxiliary lock portion is a recess structure, and the other one of the lock portion and the auxiliary portion is a protruding structure.

Preferably, the lock portion and the auxiliary lock portion are detachably connected to each other by mechanical engagement.

Preferably, the lock portion and the auxiliary lock portion are detachably connected to each other by magnetic attraction.

Preferably, the buckle assembly further comprises an unlock operating member movably disposed on the buckle structure or the auxiliary buckle structure, and the unlock operating member is pressed to unlock the lock portion and the auxiliary lock portion.

Preferably, the buckle structure is a female buckle and the auxiliary buckle structure is a male buckle.

Preferably, the buckle structure is a male buckle and the auxiliary buckle structure is a female buckle.

A baby carrier of the invention comprises a sling, a protective member for enclosing a baby, a strap and the aforesaid buckle assembly. The sling is connected to the auxiliary buckle structure. An end of the strap is connected to the protective member. Another end of the strap is connected to the connecting member of the buckle structure.

Compared to the prior art, since the strap of the baby carrier of the invention will not protrude or bulge on the buckle structure, the strap will not block the engagement between the buckle structure and the auxiliary buckle structure, such that the buckle structure and the auxiliary buckle structure can be engaged with each other quickly. Because there is no strap between the buckle structure and the auxiliary buckle structure, the "false engagement" will not occur between the buckle structure and the auxiliary buckle structure, such that the engagement is good, quick and convenient. The engagement between the buckle structure and the auxiliary buckle structure will be a precise engagement. The buckle structure and the auxiliary buckle structure will not be disengaged from each other easily by an external force. Furthermore, by means of the extension of the extending portion on the buckle structure, the protective member is away from the lock portion of the buckle structure, so as to prevent the protective member from blocking the engagement between the buckle structure and the auxiliary buckle structure. Because the strap does not protrude or bulge on the buckle structure, the buckle structure can be tightly attached to the auxiliary buckle structure every time when they are engaged. Even if the buckle structure and the auxiliary buckle structure are engaged by magnetic attraction, the engagement will not be affected by a protrusion or bulge of the strap. That is to say, the engagement between the buckle structure and the auxiliary buckle structure every time is always a precise engagement. The precise engagement effectively prevents the "false engagement". The false engagement is when the buckle structure and the auxiliary buckle structure are magnetically attracted by each other but not engaged, therefore the user may mistakenly believe that the buckle structure and the auxiliary buckle structure were firmly engaged. The protective member can be quickly and conveniently connected to the sling stably and firmly under the quick engagement between the buckle structure and the auxiliary buckle structure. Since the buckle structure and the auxiliary buckle structure can be engaged precisely and will not be disengaged from each other easily by an external force, the protective member can be safely and stably connected to the sling after the buckle structure and the auxiliary buckle structure are engaged with each other, such that the use of the baby carrier is safer and more reliable. Moreover, because there is no strap and protective member between the buckle structure and the auxiliary buckle structure, the quick engagement between the buckle structure and the auxiliary buckle structure enables the protective member to be connected to the sling conveniently and quickly.

These and other objectives of the present invention will no doubt become obvious to those of ordinary skill in the art after reading the following detailed description of the preferred embodiment that is illustrated in the various figures and drawings.

DETAILED DESCRIPTION

In order to explain the disclosure and structural features in detail, the invention will be further described with the embodiments and drawings in the following.

Figure 1:
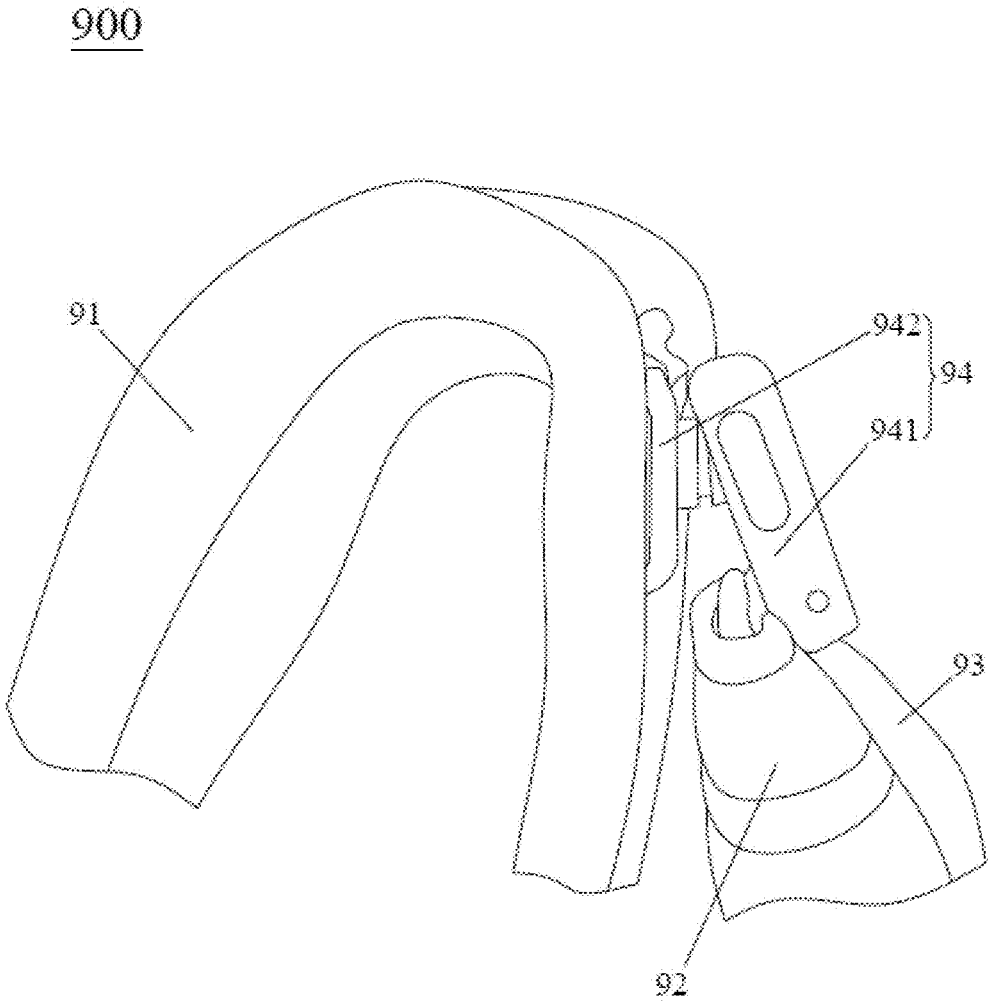
FIG. 1 PRIOR ART
FIG. 1 is a schematic view illustrating partial structure of a baby carrier of the prior art.
Figure 2:
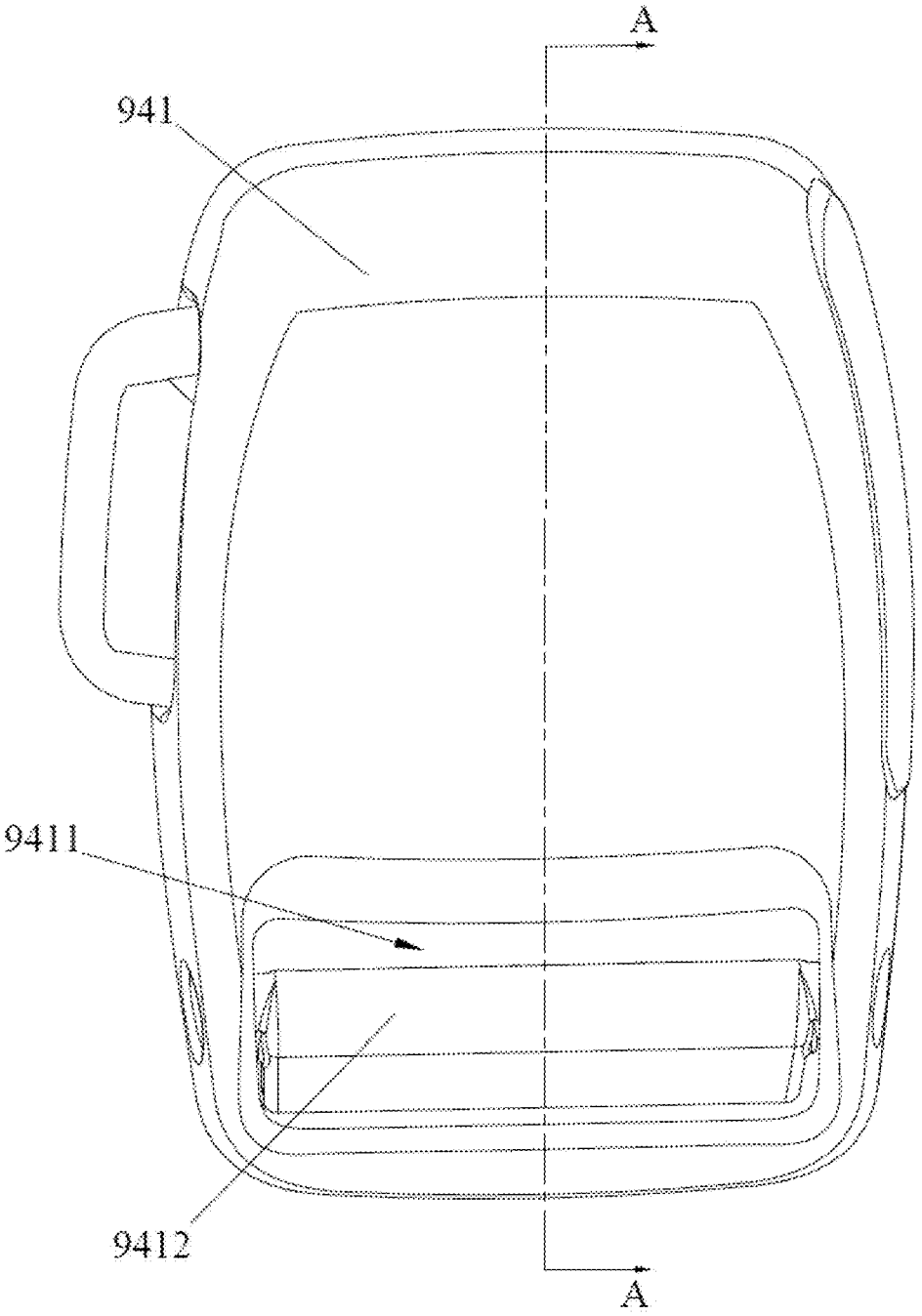
FIG. 2 PRIOR ART
FIG. 2 is a schematic view illustrating a buckle structure of the baby carrier of the prior art.
Figure 3:
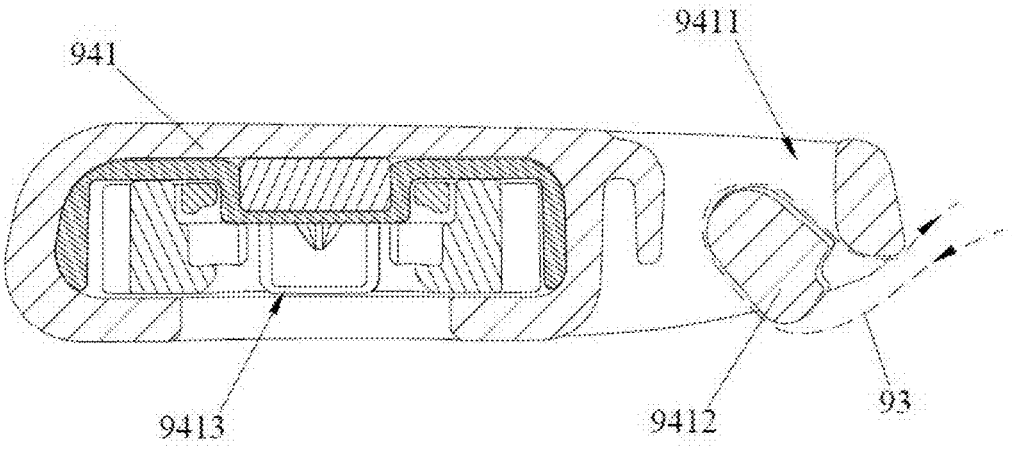
FIG. 3 PRIOR ART
FIG. 3 is a sectional view of FIG. 2 along line A-A.
Figure 4:
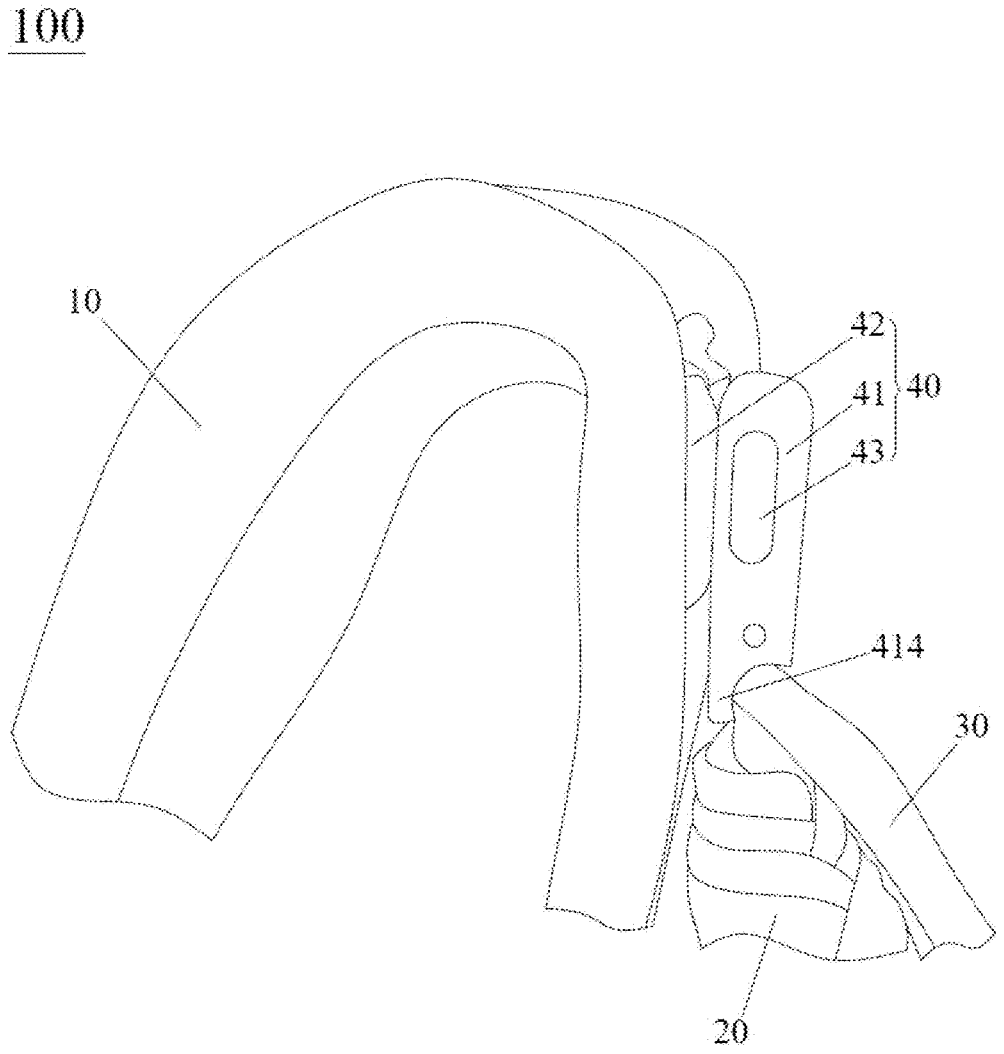
FIG. 4 is a schematic view illustrating partial structure of a baby carrier of the invention.
Figure 5:
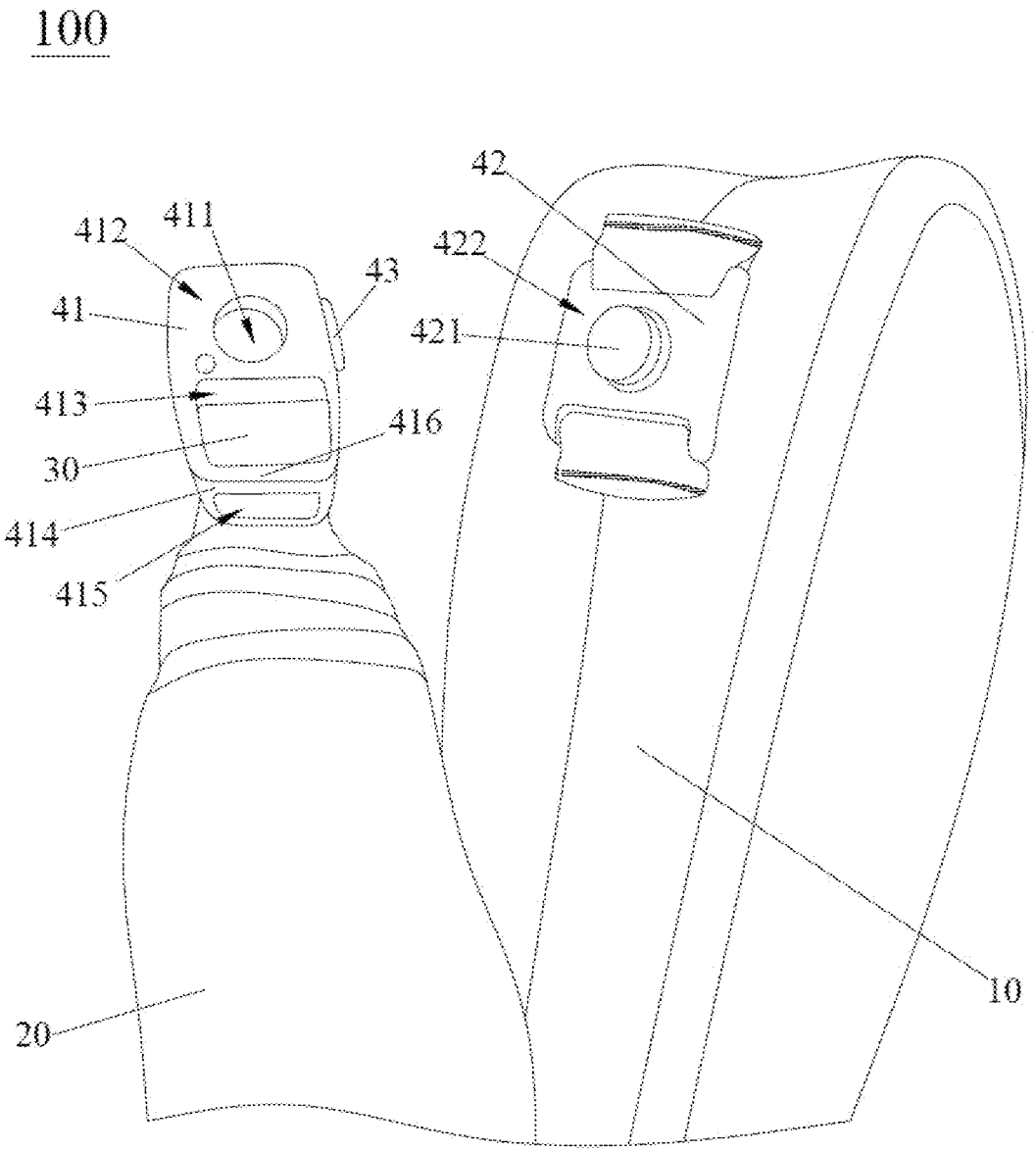
FIG. 5 is a schematic view illustrating partial structure of the baby carrier shown in FIG. 4 from another viewing angle.
Figure 6:
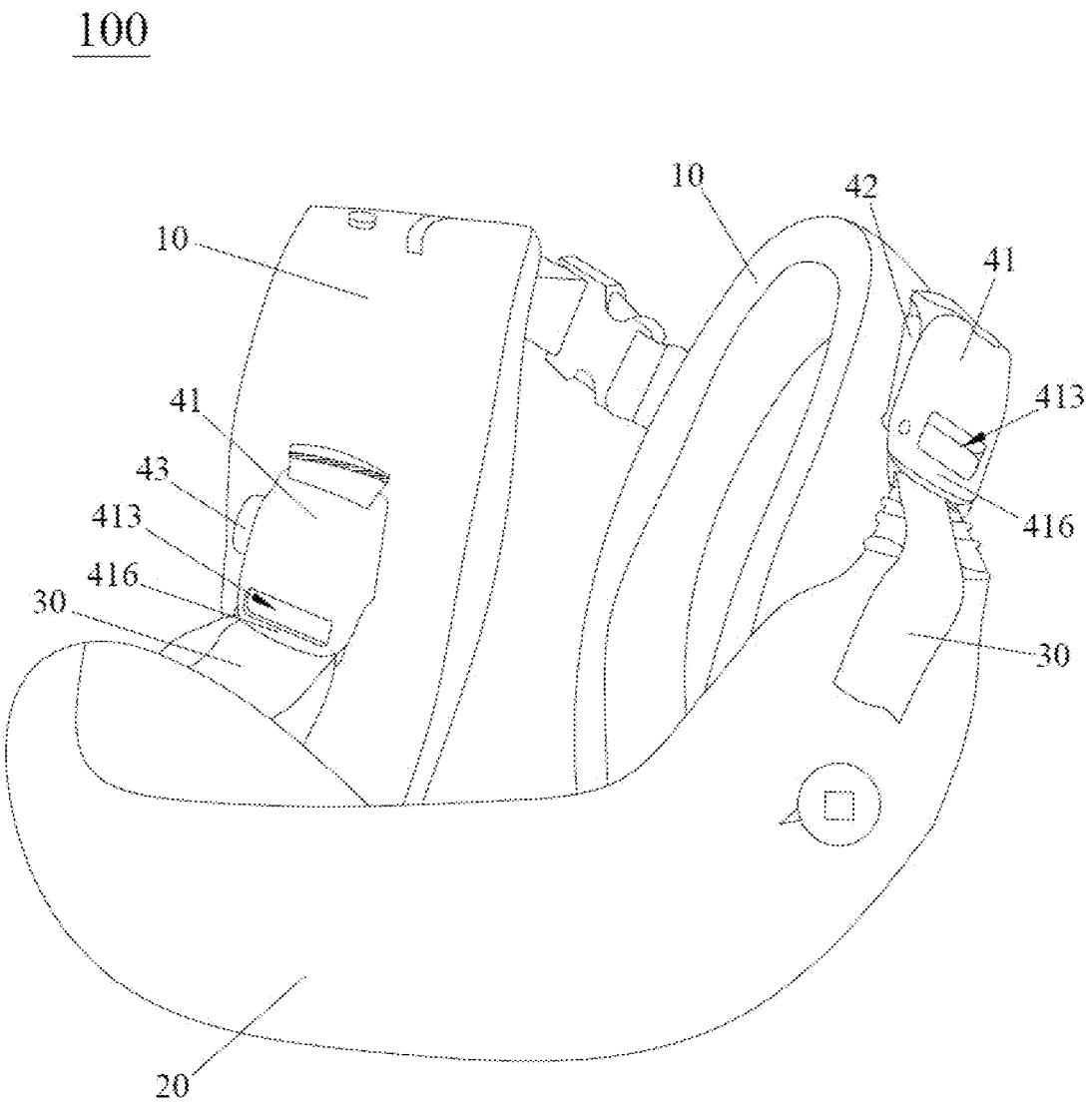
FIG. 6 is a schematic view illustrating the baby carrier shown in FIG. 4.

As shown in FIGS. 4 to 6, a baby carrier 100 of the invention comprises a sling 10, a protective member 20 for enclosing a baby, a strap 30 and a buckle assembly 40. The sling 10 is connected to an auxiliary buckle structure 40 (described in the following). An end of the strap 30 is connected to the protective member 20 and another end of the strap 30 is connected to a connecting member 44 of a buckle structure 41 (described in the following). The baby carrier 100 is used for carrying and protecting a baby. The protective member 20 is connected to the sling 10 by the engagement between the buckle structure 41 and the auxiliary buckle structure 42, such that the protective member 20 can be used conveniently. The protective member 20 is separated from the sling 10 by the disengagement between the buckle structure 41 and the auxiliary buckle structure 42, such that the protective member 20 can be stored, carried and cleaned conveniently. For example, the protective member 20 may be, but not limited to, a fabric, such as a saliva towel. The saliva towel is connected to the strap 30 by a multi-layer winding manner. The saliva towel can not only enclose the baby, but also catch the saliva flowing out of the baby. According to practical needs, the protective member 20 may also be a bag for carrying the baby, such as a net bag, so as to support and carry the baby comprehensively. The structure of the sling 10 of the invention may be a commercially available structure, such as a shoulder strap structure capable of being carried on a shoulder of a human body. The aforesaid protective member 20 is disposed between two shoulder straps, but it is not limited to the aforementioned embodiments. In this embodiment, the auxiliary buckle structure 42 is disposed on the sling 10 by stitching. According to practical needs, the auxiliary buckle structure 42 may be disposed on the sling 10 by melting, adhesion, zipper, etc., and it is not limited to the aforementioned embodiments. The buckle structure 41 and the buckle assembly 40 with the buckle structure 41 mentioned in the above will be described in further detail below in conjunction with FIGS. 4 to 8.

As shown in FIGS. 4 to 7, the buckle assembly 40 of the invention comprises the buckle structure 41 and the auxiliary buckle structure 42, wherein the buckle structure 41 and the auxiliary buckle structure 42 are capable of being superimposed and plugged with each other, such that the buckle structure 41 and the auxiliary buckle structure 42 can be engaged with each other quickly while they are superimposed. Since the buckle structure 41 and the auxiliary buckle structure 42 are superimposed after engagement, the structure of the buckle assembly after engagement is more compact. Specifically, the buckle structure 41 has a lock portion 411, the auxiliary buckle structure 42 has an auxiliary lock portion 421 for locking with the lock portion 411, and the buckle structure 41 and the auxiliary buckle structure 42 are superimposed and plugged with each other, such that the lock portion 411 and the auxiliary lock portion 421 are locked. Since the lock portion 411 and the auxiliary lock portion 421 are locked, the engagement between the buckle structure 41 and the auxiliary buckle structure 42 is more stable and reliable. For example, the lock portion 411 in this embodiment is a recess structure. When the buckle structure 41 is a female buckle, the auxiliary lock portion 421 is a protruding structure, whereby the auxiliary buckle structure 42 is a male buckle. According to practical needs, the lock portion 411 may also be a protruding structure and the buckle structure 41 is a male buckle. Correspondingly, the auxiliary lock portion 421 is a recess structure, and the auxiliary buckle structure 42 is a female buckle. The lock portion 411 and the auxiliary lock portion 421 can also be locked. The present invention is not limited to the aforesaid embodiment.

Preferably, the lock portion 411 and the auxiliary lock portion 421 are detachably connected to each other by mechanical engagement. The lock portion 411 and the auxiliary lock portion 421 may also be detachably connected to each other by magnetic attraction. According to practical needs, the lock portion 411 and the auxiliary lock portion 421 may also be detachably connected to each other by a combination of mechanical engagement and magnetic attraction. In this embodiment, a magnetic member 418 is disposed on a portion of the buckle structure 41 facing the lock portion 411. Correspondingly, at least a part of the auxiliary lock portion 421 of the auxiliary buckle structure is formed by a magnetic material. According to practical needs, a magnetic member (not shown) may also be disposed on the auxiliary lock portion 421. The present invention is not limited to the aforesaid embodiment. More specifically, the buckle assembly 40 further comprises an unlock operating member 43 movably disposed on the buckle structure 41. The unlock operating member 43 is pressed to unlock the lock portion 411 and the auxiliary lock portion 421, so as to unlock the buckle assembly 40 conveniently. According to practical needs, the unlock operating member 43 may also be disposed on the auxiliary buckle structure 42. To make the connection between the buckle structure 41 and the auxiliary buckle structure 42 more compact and stable, the buckle structure 41 has a first attaching surface 412 facing the auxiliary buckle structure 42, the auxiliary buckle structure 42 has a second attaching surface 422 facing the buckle structure 41, and the first attaching surface 412 is attached to the second attaching surface 422 after the buckle structure 41 and the auxiliary buckle structure 42 are plugged with each other.

As shown in FIGS. 4 to 8, the buckle structure 41 has a connecting port 413 and the connecting port 413 has a connecting member 44 for connecting the strap 30. An extending portion 414 extends from a side of the connecting port 413 on the buckle structure 41. The extending portion 414 has an opening 415 for the strap 30 to pass through. The strap 30 passes through the opening 415 from an outside of the opening 415 to enter the connecting port 413 and connect the connecting member 44. Accordingly, when the buckle structure 41 of the invention is being connected to the strap 30, the strap 30 is not directly inserted into the connecting port 413, but first inserted from the outside of the opening 415 on the extending portion 414 and then inserted into the connecting port 413 to connect the connecting member 44, such that the strap 30 is bent by the extending portion 414 and the opening 415, and is then connected with the connecting member 44. Accordingly, the strap 30 is effectively restrained and close to the buckle structure 41, such that the strap 30 does not protrude or bulge on the buckle structure 41, so as to prevent undesirable connection between the buckle structure 41 and the auxiliary buckle structure 42. At the same time, the extension of the extending portion 414 on the buckle structure 41 prevents the strap 30 from protruding or bulging on the buckle structure 41. Since the strap 30 will not block the engagement between the buckle structure 41 and the auxiliary buckle structure 42, the buckle structure 41 and the auxiliary buckle structure 42 can be engaged with each other quickly. Because there is no strap 30 between the buckle structure 41 and the auxiliary buckle structure 42, the "false engagement" will not occur between the buckle structure 41 and the auxiliary buckle structure 42. The engagement between the buckle structure 41 and the auxiliary buckle structure 42 will be a precise engagement. The buckle structure 41 and the auxiliary buckle structure 42 will not be disengaged from each other easily by an external force. Without being blocked by the strap 30, the buckle structure 41 and the auxiliary buckle structure 42 can be directly superimposed and plugged, and it does not need to take time to arrange the strap 30 between the buckle structure 41 and the auxiliary buckle structure 42. The operation is convenient and quick. Because the strap 30 does not protrude or bulge on the buckle structure 41, the buckle structure 41 can be tightly attached to the auxiliary buckle structure 42 every time when they are engaged. Even if the buckle structure 41 and the auxiliary buckle structure 42 are engaged by magnetic attraction, the engagement will not be affected by a protrusion or bulge of the strap. That is to say, the engagement between the buckle structure 41 and the auxiliary buckle structure 42 is always a precise engagement. The precise engagement effectively prevents the "false engagement". The false engagement is when the buckle structure and the auxiliary buckle structure are magnetically attracted by each other but not engaged, therefore the user may mistakenly believe that the buckle structure 41 and the auxiliary buckle structure 42 were firmly engaged. Therefore, the engagement operation of the buckle assembly is simpler and more convenient. Furthermore, by means of the extension of the extending portion 414 on the buckle structure 41, the protective member 20 is away from the lock portion 411 of the buckle structure 41, so as to prevent the protective member 20 from blocking the engagement between the buckle structure 41 and the auxiliary buckle structure 42. Since the buckle structure 41 and the auxiliary buckle structure 42 can be engaged precisely and will not be disengaged from each other easily by an external force, the protective member 20 can be safely and stably connected to the sling 10 after the buckle structure 41 and the auxiliary buckle structure 42 are engaged with each other, such that the use of the baby carrier 100 is safer and more reliable. Moreover, because there are no strap 30 and protective member 20 between the buckle structure 41 and the auxiliary buckle structure 42, the quick engagement between the buckle structure 41 and the auxiliary buckle structure 42 enables the protective member 20 to be connected to the sling 10 conveniently and quickly. For example, the buckle structure 41 forms the extending portion 414 along a longitudinal direction thereof to ensure that the protective member 20 is effectively deviated from the lock portion 411 on the buckle structure 41. The present invention is not limited to aforementioned embodiments.

As shown in FIGS. 4 to 8, after entering the connecting port 413 and connecting the connecting member 44, the strap 30 passes through the opening 415 again. The strap 30 passes through the opening 415 so that the strap 30 will not affect the engagement between the buckle structure 41 and the auxiliary buckle structure 42. Specifically, the strap 30 is slidably connected to the connecting member 44 and a length of the strap 30 is adjustable. The effective length and tightness of the strap 30 can be easily adjusted by pulling the strap 30, such that the protective member 20 can be adapted to babies with different sizes. In other embodiments, the strap 30 can be fixedly disposed on the connecting member 44 according to practical needs. For example, the tail of the strap 30 is fixed on the connecting member 44 by winding and stitching. At this time, the strap 30 cannot be adjusted with respect to the connecting member 44, but the protective member 20 is still being restrained outside of the extending portion 414. The strap 30 will not affect the precise engagement between the buckle structure 41 and the auxiliary buckle structure 42. Preferably, the strap 30 is wound around the connecting member 44, so as to adjust the strap 30 quickly. The present invention is not limited to the aforementioned embodiments. More specifically, the connecting member 44 is pivotally disposed on the buckle structure 41, such that the strap 30 and the connecting member 44 are connected in a rolling manner, which facilitates the adjustment of the strap 30 with respect to the connecting member 44. According to practical needs, the connecting member 44 may also be fixedly disposed on the buckle structure 41, and the strap 30 may also be connected to the connecting piece 44 with an adjustable length. For example, the connecting member 44 may be, but not limited to, a rod-shaped member. The structure of the connecting member 44 is well known in the art, so it will not be repeated herein. In order to prevent the strap 30 and the protective member 20 from affecting the engagement between the buckle structure 41 and the auxiliary buckle structure 42, the lock portion 411 is disposed on the first attaching surface 412 and the auxiliary lock portion 421 is disposed on the second attaching surface 422. The opening 415 and the connecting port 413 are disposed on a side surface of the buckle structure 41 opposite to the first attaching surface 412.

Figure 7:
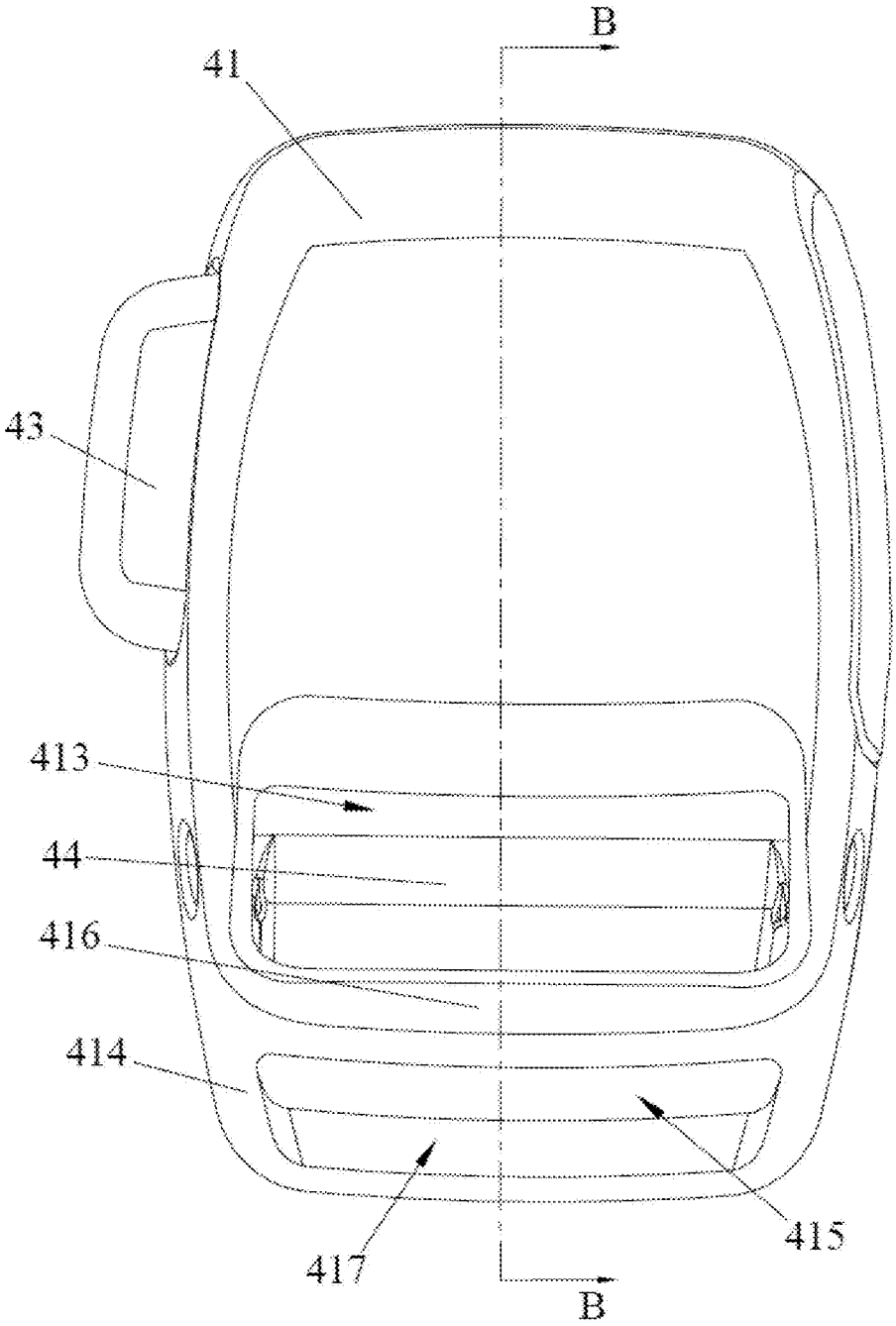
FIG. 7 is a schematic view illustrating a buckle structure of the invention.
Figure 8:
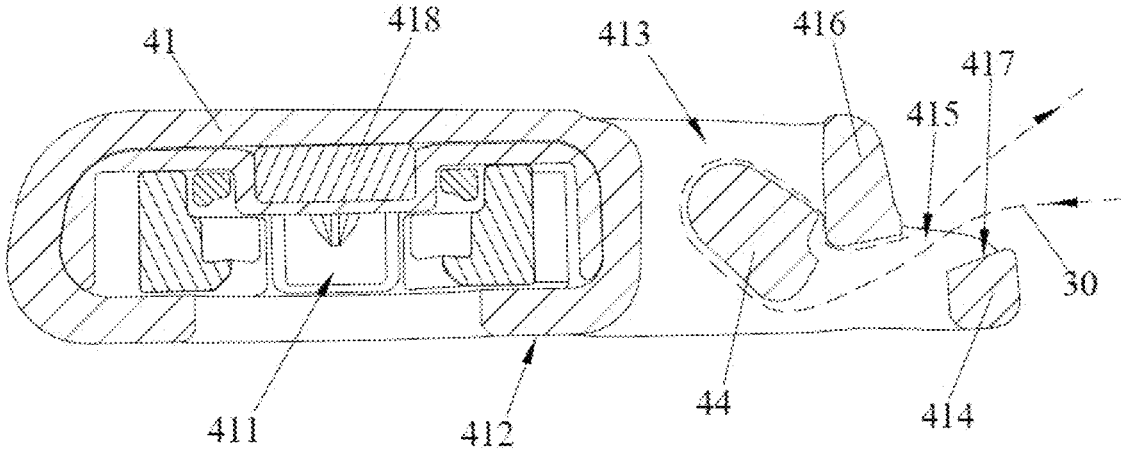
FIG. 8 is a sectional view of FIG. 7 along line B-B.

As shown in FIGS. 7 and 8, the opening 415 faces the connecting member 44 to ensure that the strap 30 connected to the connecting member 44 after entering the opening 415 does not sag excessively, causing the strap 30 to go out of the bottom of the buckle structure 41, so as to avoid affecting the engagement between the buckle structure 41 and the auxiliary buckle structure 42. Specifically, a width of the opening 415 gradually expands in a direction toward the connecting member 44, such that the strap 30 is curled when it is inserted into the opening 415, and the strap 30 can be completely spread out after passing through the opening 415. Therefore, the arrangement of the opening 415 facilitates the quick and smooth insertion of the strap 30 into the opening 415. More specifically, the bottom of the buckle structure 41 is flat, such that the buckle structure 41 and the auxiliary buckle structure 42 can be attached to each other more tightly.

As shown in FIGS. 7 and 8, the buckle structure 41 further comprises a partition 416 separating the connecting port 413 from the opening 415. The partition 416 is arranged in a width direction of the buckle structure 41. The connecting port 413 and the opening 415 are arranged in a longitudinal direction of the buckle structure 41 in sequence. This arrangement facilitates the strap 30 passing through the opening 415 to be connected to the connecting member 44 more conveniently and quickly, and keeps the strap 30 taut. Specifically, the extending portion 414 is located below the partition 416 in a height direction of the buckle structure 41, and the extending portion 414 and the partition 416 form a stair structure. The stair structure can block the protective member 20 and provide a position for the protective member 20. Since the positioned protective member 20 is outside the extending portion 414, it is ensured that the protective member 20 will not protrude or bulge on the buckle structure 41, and the protective member 20 will not block the engagement between the buckle structure 41 and the auxiliary buckle structure 42. More specifically, the extending portion 414 is a ring-shaped structure, the ring-shaped structure surrounds the opening 415, and a top of the extending portion 414 has an inclined structure 417 inclined toward a lower end of the connecting port 413. The strap 30 can pass through the opening 415 quickly and smoothly through the inclined structure 417. In order to provide a space for accommodating the strap 30 in the buckle structure 41 and to prevent the strap 30 from going over the bottom surface of the buckle structure 41, an extension line of the inclined structure 417 is apart from the lowermost end of the connecting member 44 by a specific distance. Preferably, the extension line of the inclined structure 417 is apart from the lowermost end of the connecting member 44 by a distance at least larger than a thickness of the strap 30.

As shown in FIGS. 4 to 8, the operation principle of the baby carrier 100 of the invention will be described in the following. When the baby carrier 100 of the invention is in use, the buckle structure 41 and the auxiliary buckle structure 42 are superimposed and plugged, and the lock portion 411 is locked with the auxiliary lock portion 421, so as to achieve the connection between the protective member 20 (e.g. a saliva towel or a cloth) and the sling 10. A space is formed in front of the protective member 20 and the sling 10 for accommodating a baby. The tightness of the strap 30 is adjusted by pulling the strap 30 on the buckle structure 41, so as to adjust the size of the space for accommodating the baby, such that the baby carrier 100 can be adapted to the needs of babies at different growth stages. After using the baby carrier 100, the protective member 20 may be taken off to meet the practical needs. At this time, the lock between the lock portion 411 and the auxiliary lock portion 421 can be unlocked by pressing the unlock operating member 43. The buckle structure 41 and the auxiliary buckle structure 42 can be separated, and then the sling 10 can be removed from the protective member 20. The operation principle is as mentioned in the above.

As shown in FIGS. 4 to 8, since the buckle structure 41 of the invention has the extending portion 414 and the opening 415, the strap 30 is first inserted from the outside of the opening 415 on the extending portion 414 and then inserted into the connecting port 413 to connect the connecting member 44, such that the strap 30 is bent by the extending portion 414 and the opening 415, and is then connected with the connecting member 44. Accordingly, the strap 30 is restrained and close to the buckle structure 41, such that the strap 30 does not protrude or bulge on the buckle structure 41. Furthermore, the extension of the extending portion 414 on the buckle structure 41 prevents the strap 30 from protruding or bulging on the buckle structure 41. Since the strap 30 will not protrude or bulge on the buckle structure 41, the strap 30 will not block the engagement between the buckle structure 41 and the auxiliary buckle structure 42, such that the buckle structure 41 and the auxiliary buckle structure 42 can be engaged with each other quickly. Because there is no strap 30 between the buckle structure 41 and the auxiliary buckle structure 42, the "false engagement" will not occur between the buckle structure 41 and the auxiliary buckle structure 42. The engagement between the buckle structure 41 and the auxiliary buckle structure 42 will be a precise engagement. The buckle structure 41 and the auxiliary buckle structure 42 will not be disengaged from each other easily by an external force. Without being blocked by the strap 30, the buckle structure 41 and the auxiliary buckle structure 42 can be directly superimposed and plugged, and it does not need to take time to arrange the strap 30 between the buckle structure 41 and the auxiliary buckle structure 42. The operation is convenient and quick. Because the strap 30 does not protrude or bulge on the buckle structure 41, the buckle structure 41 can be tightly attached to the auxiliary buckle structure 42 every time when they are engaged. Even if the buckle structure 41 and the auxiliary buckle structure 42 are engaged by magnetic attraction, the engagement will not be affected by a protrusion or bulge of the strap. That is to say, the engagement between the buckle structure 41 and the auxiliary buckle structure 42 is always a precise engagement. The precise engagement effectively prevents the "false engagement". The false engagement is when the buckle structure and the auxiliary buckle structure are magnetically attracted by each other but not engaged, therefore the user may mistakenly believe that the buckle structure 41 and the auxiliary buckle structure 42 were firmly engaged.

Understandably, the buckle assembly 40 of the invention comprises the aforesaid buckle structure 41 and the auxiliary buckle structure 42 capable of being superimposed and plugged with the buckle structure 41. Since the strap 30 is restrained and close to the buckle structure 41, the strap 30 does not protrude or bulge on the buckle structure 41. Accordingly, the strap 30 will not block the engagement between the buckle structure 41 and the auxiliary buckle structure 42, such that the buckle structure 41 and the auxiliary buckle structure 42 can be engaged with each other quickly. Because there is no strap 30 between the buckle structure 41 and the auxiliary buckle structure 42, the "false engagement" will not occur between the buckle structure 41 and the auxiliary buckle structure 42, such that the engagement is good, quick and convenient. The engagement between the buckle structure 41 and the auxiliary buckle structure 42 will be a precise engagement. The buckle structure 41 and the auxiliary buckle structure 42 will not be disengaged from each other easily by an external force. Because the strap 30 does not protrude or bulge on the buckle structure 41, the buckle structure 41 can be tightly attached to the auxiliary buckle structure 42 every time when they are engaged. Even if the buckle structure 41 and the auxiliary buckle structure 42 are engaged by magnetic attraction, the engagement will not be affected by a protrusion or bulge of the strap. That is to say, the engagement between the buckle structure 41 and the auxiliary buckle structure 42 is always a precise engagement. The precise engagement effectively prevents the "false engagement". The false engagement is when the buckle structure and the auxiliary buckle structure are magnetically attracted by each other but not engaged, therefore the user may mistakenly believe that the buckle structure and the auxiliary buckle structure 42 were firmly engaged. Therefore, the engagement operation of the buckle assembly 40 is simpler and more convenient.

Still further, the baby carrier 100 of the invention comprises the sling 10, the protective member 20 for enclosing a baby, the strap 30 and the aforesaid buckle assembly 40. The strap 30 will not block the engagement between the buckle structure 41 and the auxiliary buckle structure 42, such that the buckle structure 41 and the auxiliary buckle structure 42 can be engaged with each other quickly. Because there is no strap 30 between the buckle structure 41 and the auxiliary buckle structure 42, the "false engagement" will not occur between the buckle structure 41 and the auxiliary buckle structure 42, such that the engagement is good, quick and convenient. The engagement between the buckle structure 41 and the auxiliary buckle structure 42 will be a precise engagement. The buckle structure 41 and the auxiliary buckle structure 42 will not be disengaged from each other easily by an external force, so as to ensure that the protective member 20 can be safely and reliably connected to the sling 10. Because the strap 30 does not protrude or bulge on the buckle structure 41, the buckle structure 41 can be tightly attached to the auxiliary buckle structure 42 every time when they are engaged. Even if the buckle structure 41 and the auxiliary buckle structure 42 are engaged by magnetic attraction, the engagement will not be affected by a protrusion or bulge of the strap. That is to say, the engagement between the buckle structure 41 and the auxiliary buckle structure 42 is always a precise engagement. The precise engagement effectively prevents the "false engagement". The false engagement is when the buckle structure and the auxiliary buckle structure are magnetically attracted by each other but not engaged, therefore the user may mistakenly believe that the buckle structure 41 and the auxiliary buckle structure 42 were firmly engaged. Therefore, the protective member 20 can be quickly and conveniently connected to the sling 10 in a stable and firm manner under the quick engagement between the buckle structure 41 and the auxiliary buckle structure 42. Furthermore, by means of the extension of the extending portion 414 on the buckle structure 41, the protective member 20 is away from the lock portion 411 of the buckle structure 41, so as to prevent the protective member 20 from blocking the engagement between the buckle structure 41 and the auxiliary buckle structure 42. Since the buckle structure 41 and the auxiliary buckle structure 42 can be engaged precisely and will not be disengaged from each other easily by an external force, the protective member 20 can be safely and stably connected to the sling 10 after the buckle structure 41 and the auxiliary buckle structure 42 are engaged with each other, such that the use of the baby carrier 100 is safer and more reliable. Moreover, because there is no strap 30 and protective member 20 between the buckle structure 41 and the auxiliary buckle structure 42, the quick engagement between the buckle structure 41 and the auxiliary buckle structure 42 enables the protective member 20 to be connected to the sling 10 conveniently and quickly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A buckle structure adapted to connect a strap, the buckle structure having a connecting port, the connecting port having a connecting member for connecting the strap, an extending portion extending from a side of the connecting port, the extending portion having an opening for the strap to pass through, the strap passing through the opening to enter the connecting port and connect the connecting member, wherein a width of the opening gradually expands in a direction toward the connecting member.

2. The buckle structure of claim 1, wherein the buckle structure forms the extending portion along a longitudinal direction thereof.

3. The buckle structure of claim 1, wherein after entering the connecting port and connecting the connecting member, the strap passes through the opening again.

4. The buckle structure of claim 1, wherein the strap is slidably connected to the connecting member and a length of the strap is adjustable.

5. The buckle structure of claim 1, wherein the strap is wound around the connecting member.

6. The buckle structure of claim 1, wherein the connecting member is pivotally disposed on the buckle structure.

7. The buckle structure of claim 1, wherein the opening faces the connecting member.

8. The buckle structure of claim 1, wherein the buckle structure further comprises a partition separating the connecting port from the opening, the partition is arranged in a width direction of the buckle structure, and the connecting port and the opening are arranged in a longitudinal direction of the buckle structure in sequence.

9. The buckle structure of claim 8, wherein the extending portion is located below the partition in a height direction of the buckle structure, and the extending portion and the partition form a stair structure.

10. The buckle structure of claim 1, wherein the extending portion is a ring-shaped structure, the ring-shaped structure surrounds the opening, and a top of the extending portion has an inclined structure inclined toward a lower end of the connecting port.

11. The buckle structure of claim 10, wherein an extension line of the inclined structure is apart from a lowermost end of the connecting member by a specific distance.

12. The buckle structure of claim 10, wherein an extension line of the inclined structure is apart from a lowermost end of the connecting member by a distance at least larger than a thickness of the strap.

13. The buckle structure of claim 1, wherein a bottom of the buckle structure is flat.

14. A buckle assembly comprising the buckle structure of claim 1 and an auxiliary buckle structure, the buckle structure and the auxiliary buckle structure capable of being superimposed and plugged with each other.

15. The buckle assembly of claim 14, wherein the buckle structure has a lock portion, the auxiliary buckle structure has an auxiliary lock portion for locking with the lock portion, and the buckle structure and the auxiliary buckle structure are superimposed and plugged with each other, such that the lock portion and the auxiliary lock portion are locked.

16. The buckle assembly of claim 15, wherein the buckle structure has a first attaching surface facing the auxiliary buckle structure, the auxiliary buckle structure has a second attaching surface facing the buckle structure, and the first attaching surface is attached to the second attaching surface after the buckle structure and the auxiliary buckle structure are plugged with each other.

17. The buckle assembly of claim 16, wherein the lock portion is disposed on the first attaching surface, the auxiliary lock portion is disposed on the second attaching surface, and the opening and the connecting port are disposed on a side surface of the buckle structure opposite to the first attaching surface.

18. The buckle assembly of claim 15, wherein one of the lock portion and the auxiliary lock portion is a recess structure, and the other one of the lock portion and the auxiliary portion is a protruding structure.

19. The buckle assembly of claim 15, wherein the lock portion and the auxiliary lock portion are detachably connected to each other by mechanical engagement.

20. The buckle assembly of claim 15, wherein the lock portion and the auxiliary lock portion are detachably connected to each other by magnetic attraction.

21. The buckle assembly of claim 15, wherein the buckle assembly further comprises an unlock operating member movably disposed on the buckle structure or the auxiliary buckle structure, and the unlock operating member is pressed to unlock the lock portion and the auxiliary lock portion.

22. The buckle assembly of claim 14, wherein the buckle structure is a female buckle and the auxiliary buckle structure is a male buckle.

23. The buckle assembly of claim 14, wherein the buckle structure is a male buckle and the auxiliary buckle structure is a female buckle.

24. A baby carrier comprising a sling, a protective member for enclosing a baby, a strap and the buckle assembly of claim 15, the sling being connected to the auxiliary buckle structure, an end of the strap being connected to the protective member, another end of the strap being connected to the connecting member of the buckle structure.

* * * * *